US008695494B2

(12) United States Patent
Graf

(10) Patent No.: US 8,695,494 B2
(45) Date of Patent: Apr. 15, 2014

(54) METHOD FOR RAPID COOLING OF A HOT ISOSTATIC PRESS AND A HOT ISOSTATIC PRESS

(75) Inventor: Matthias Graf, Bretten (DE)

(73) Assignee: Cremer Thermoprozessanlagen GmbH, Duren-Konzendorf (DE)

( * ) Notice: Subject to any disclaimer, the term of this patent is extended or adjusted under 35 U.S.C. 154(b) by 780 days.

(21) Appl. No.: 12/125,026

(22) Filed: May 21, 2008

(65) Prior Publication Data

US 2009/0000495 A1 Jan. 1, 2009

(30) Foreign Application Priority Data

May 22, 2007 (DE) ..... 10 2007 023 699

(51) Int. Cl.

| | |
|---|---|
| ***B30B 15/34*** | (2006.01) |
| ***B22F 3/15*** | (2006.01) |
| ***B30B 11/00*** | (2006.01) |
| *F28C 3/02* | (2006.01) |
| *F28F 13/02* | (2006.01) |

(52) U.S. Cl.

CPC ..... *B22F 3/15* (2013.01); *B30B 11/002* (2013.01); *B22F 2003/153* (2013.01); *F28C 3/02* (2013.01); *F28F 13/02* (2013.01)

USPC ..... 100/38; 100/305; 425/405.2

(58) Field of Classification Search

USPC ..... 100/38, 92, 305, 323; 425/405.2; 419/25, 42, 49, 68; 432/199

See application file for complete search history.

(56) References Cited

U.S. PATENT DOCUMENTS

| | | | | |
|---|---|---|---|---|
| 2,493,246 | A | 1/1950 | Wardle et al. | |
| 4,867,918 | A * | 9/1989 | Kiyonaga et al. | 261/76 |
| 5,123,832 | A * | 6/1992 | Bergman et al. | 425/405.2 |
| 5,290,189 | A | 3/1994 | Hemsath et al. | |
| 6,250,907 | B1 * | 6/2001 | Bergman | 425/210 |
| 6,331,271 | B1 * | 12/2001 | Bergman | 419/49 |
| 2003/0197295 | A1 | 10/2003 | Nakai et al. | |
| 2004/0069111 | A1 | 4/2004 | Watanabe et al. | |
| 2005/0064582 | A1 * | 3/2005 | Wittwer et al. | 435/287.2 |
| 2006/0201221 | A1 * | 9/2006 | Sehlstedt | 72/201 |

FOREIGN PATENT DOCUMENTS

| | | |
|---|---|---|
| DE | 38 33 337 | 4/1990 |
| EP | 1 995 006 A | 11/2008 |
| JP | 2302587 A | 12/1990 |
| JP | 2005-016861 A | 1/2005 |

(Continued)

OTHER PUBLICATIONS

U.S. Appl. No. 13/130,553, filed May 20, 2011, Mathias Graf.

(Continued)

*Primary Examiner* — Jimmy T Nguyen

(74) *Attorney, Agent, or Firm* — Foley & Lardner LLP

(57) ABSTRACT

A system and method for rapid cooling a hot isostatic press including a pressure container. The pressure container has an internal load space and includes insulation disposed at least partially around the load space, heating elements disposed inside the insulation, and a load disposed on a load bearing plate. Fluid is directed into the load space of a pressure container using at least one nozzle to form a rotational flow. The fluid from the at least one nozzle is mixed as it passes through the rotational flow near the insulation with fluid near the load. The fluid from the at least one nozzle has a lower temperature than the fluid in the load space and/or the load.

22 Claims, 5 Drawing Sheets

(56) References Cited

FOREIGN PATENT DOCUMENTS

| | | | |
|---|---|---|---|
| WO | WO-98/56525 | A | 12/1998 |
| WO | WO-00/15371 | A | 3/2000 |
| WO | WO-03/070402 | | 8/2003 |

OTHER PUBLICATIONS

U.S. Appl. No. 13/130,557, filed May 20, 2011, Mathias Graf.
Dieffenbacher GmbH Isocool Flyer Providing the Technology of the Isostatic Patent, www.dieffenbacher.com.
Dieffenbacher GmbH Prospect English 1009 Brochure/Technology Information Package, www.dieffenbacher.de.
International Search Report dated Apr. 12, 2010 as received in corresponding PCT Application No. PCT/EP2009/008329, 6 pages.
International Search Report dated Mar. 12, 2010 as received in corresponding PCT Application No. PCT/EP2009/008331, 6 pages.
Chinese Office Action dated Apr. 20, 2011; Application/Patent No. 200810214731.0 with English Translation.
European Office Action dated Sep. 9, 2010; Application No./Patent No. 08008674.7-1215-1995006 with English Translation and European Response dated Jul. 11, 2011.

* cited by examiner

METHOD FOR RAPID COOLING OF A HOT ISOSTATIC PRESS AND A HOT ISOSTATIC PRESS

BACKGROUND

The application relates to a method for rapid cooling of a hot isostatic press and a hot isostatic press.

Conventional hot isostatic pressing (HIP) or autoclave furnaces are used in many fields. For example, solid workpieces or molding compounds composed of powder can be compacted in a matrix under high pressure and at a high temperature to connect different materials or materials of the same type. Typically, the workpieces are placed in a furnace with a heating system and the furnace is enclosed by a high pressure container. During or after the heating operation, a complete isostatic compaction can take place by the pressure of a fluid, such as a liquid and/or inert gas (e.g., argon), on all sides until the workpieces are optimally compacted. This method can also be used for post-compact components, for example components made of ceramic materials such as for hip joint prostheses, for aluminum castings in the construction of cars or engines, for cylinder heads of passenger vehicle engines, or for precision castings made of titanium alloys (e.g., turbine blades). During a post-compaction operation under high pressure and at a high temperature, pores that evolved during the production process can be closed, existing faults can be connected, and the joining properties can be improved. Another field of application is the production of components that are composed of particulate materials and close to their final contour. Components made of particulate materials can be compacted and sintered.

Conventional HIP cycles can last a very long time—from several hours to several days. A sizable portion of the cycle costs are due to the tie-up of capital in the machine hour rate, especially the relatively long periods of cooling the operating temperature to a more reliable temperature at which the pressing system can be opened with less danger. The cooling cycles generally account for about one third of the cycle time and offer few to no benefits from a process engineering viewpoint. It is known that the cooling operation is an important factor for the material properties of the parts that are to be produced. Many materials require that a defined maximum cooling rate be observed to maintain the quality of the material. In addition, during the cooling operation the workpiece must be cooled uniformly—evenly throughout the volume—rather than non-uniformly with different temperature zones. When large components are produced, the internal stresses at different temperatures may lead to distortions, cracks with a corresponding notch effect, or to complete destruction. Such problems can occur even in the case of small parts that are generally deposited in a frame or on a shelf in the furnace.

Autoclaves that circulate hot gas with or without mechanical aids (e.g., a blower) are known in the art. When used without mechanical aids, an autoclave can perform natural convection and re-distribution of gas because of existing or promoted temperature differences (e.g., heating or cooling at the outer walls); as the cooler fluid flows downwards, the warmer fluid rises. With the use of guide elements, the fluid flow can be controlled to circulate more uniform heating or cooling in the autoclave. Conventional autoclaves typically use guide or convection shells that include an upper and a lower open tube. During the heating operation, heat sources in the furnace provide a flow as a function of the arrangement of the heat source. During the cooling operation, the cooled fluid flows downwards between the convection shell and the cooling outer wall and pushes the warmer fluid upwards past the workpieces in the interior of the shell. At the top cover of the HIP system, the flow coming from the bottom pushes the fluid in the direction of the outer regions causing the fluid to flow downward between the outer wall and the shell, maintaining a continuous cooling process.

One embodiment for rapid cooling of an HIP system is disclosed, for example, in published German patent application DE 38 33 337 A1. In the case of this solution, in order to start rapidly cooling, a gas circulation between the hot space inside the insulating hood and the cold space outside the insulating hood is produced by opening the circulation with valves in a bottom space. The upper top cover of the insulating hood exhibits continuously open boreholes through which the hot fluid can exit. One drawback with this embodiment is that very cold fluid flows back from the bottom space into the hot space and makes direct contact with the load of the furnace and/or the workpieces. Therefore, the hot space is filled with cold gas from the bottom to the top. This feature has the drawback that, on the one hand, a sudden cooling can occur with adjustable parameters that are too uncertain, and no uniform cooling rate over the entire charge space can be achieved. In the case of large components, the non-uniform cooling can cause distortion, cracks, or destruction.

WO 2003/070 402 A1 discloses a method for cooling a hot isostatic press and a hot isostatic press. According to this method, hot fluid leaves the load space, is mixed with a cool falling fluid outside the load space, and the mixed fluid is recycled again into the load space. The method itself is complicated in its targeted conditions and, furthermore, requires, in addition, a complicated construction of an associated hot isostatic press with many guiding regions. Disadvantageous also is that the re-introduced mixed fluid can flow back in an uncontrollable manner into the load space, where under some circumstances it can lead to varying cooling rates if the undercuts of the load or the support structures of the load prevent proper flow through the load space. Furthermore, the gas, which is cooled to a mixing temperature, is conveyed from the bottom into the load space, a feature that undeniably leads to a temperature gradient between the bottom end and the upper end of the load space. Therefore, a uniform cooling rate cannot be achieved.

SUMMARY

Against this background, an object of the present application is to provide a method for rapid cooling of a hot isostatic press and to create a hot isostatic press suitable for carrying out the method. Both method and device enable a uniform cooling of the load space and/or the load. According to exemplary embodiments, a colder fluid is mixed promptly with a hot fluid in the load space of the hot isostatic press and simultaneously an adequately rapid and, above all, secured circulation of the fluid in the entire pressure container, but especially in the load space, is achieved, in order to achieve a uniform cooling of the entire load.

According to an exemplary embodiment, a rapid cooling method that achieves this object may provide at least one nozzle to deliver a fluid into the interior of the load space of a pressure container and form a rotational flow. While the fluid passes through the rotational flow in the vicinity of or near the insulation, the fluid can mix with fluid from the vicinity of or near the load. Therefore, the fluid from the at least one nozzle exhibits a lower temperature than the fluid in the load space and/or the load.

According to an exemplary embodiment, a hot isostatic press for carrying out the method includes a pressure container that includes at least one line with a connection to at least one nozzle in the interior of the load space. The line can be provided with fluid having a lower temperature than the fluid in the load space and/or the load.

According to various exemplary embodiments, a targeted jetting or directing of cool fluid into an upper region of the pressure container causes a rotational flow inside the load space. Directing fluid at a high speed in the upper end of the load space causes a cyclone effect inside the load space. Cooler fluid emerging from the nozzle moves in a so-called circle (as shown schematically in, e.g., FIG. 1) because of the rotation along the insulation and falls or flows downward because of the higher fluid density. The absence of a separation in the direction of the load space causes the hotter fluid near the load to mix with the colder fluid that is moved via the cyclone effect. At the same time, the ensuing downwards flow of the fluid transports the hot fluid from the internal region of the load space to produce a mixing temperature. An optimal and uniform cooling gradient of the individual load parts may be caused by an optimal thorough mixing and a protection of the load against a fluid that is too cold. The rotational movement of the fluid in the interior of the load space also guarantees that rising and falling fluid flows can not cause any temperature niches in the load space because of the undercuts of the load or a load carrier. Niches with normally stationary fluid are thoroughly mixed because of the rotating fluid and resulting additional turbulence, for example at the undercuts, to perfectly compensate for the temperature differences.

As soon as the rapid cooling commences, applicant's inventive features make it possible to achieve a uniform temperature distribution over the entire load space during the prolonged cooling phase.

One embodiment of the application relates to a method for rapid cooling a hot isostatic press including a pressure container. The pressure container has an internal load space and includes insulation disposed at least partially around the load space, heating elements disposed inside the insulation, and a load disposed on a load bearing plate. The method includes directing fluid into the load space of a pressure container using at least one nozzle to form a rotational flow and mixing the fluid from the at least one nozzle as it passes through the rotational flow near the insulation with fluid near the load. The fluid from the at least one nozzle has a lower temperature than the fluid in the load space and/or the load.

Another embodiment of the application relates to a hot isostatic press. The hot isostatic press includes a pressure container having an internal load space and including an insulation disposed at least partially around the load space, heating elements disposed inside the insulation, a load disposed on a load bearing plate, at least one nozzle for directing fluid into the load space to form a rotational flow, and at least one line with a connection to the at least one nozzle in the load space. The at least one line is arranged inside the pressure container and is provided with a fluid having a lower temperature than a fluid in the load space and/or the load.

BRIEF DESCRIPTION OF THE DRAWINGS

Other advantageous measures and embodiments of the subject matter of the application are disclosed in the dependent claims and the following description with the drawings.

DETAILED DESCRIPTION OF THE EXEMPLARY EMBODIMENTS

Figure 1:
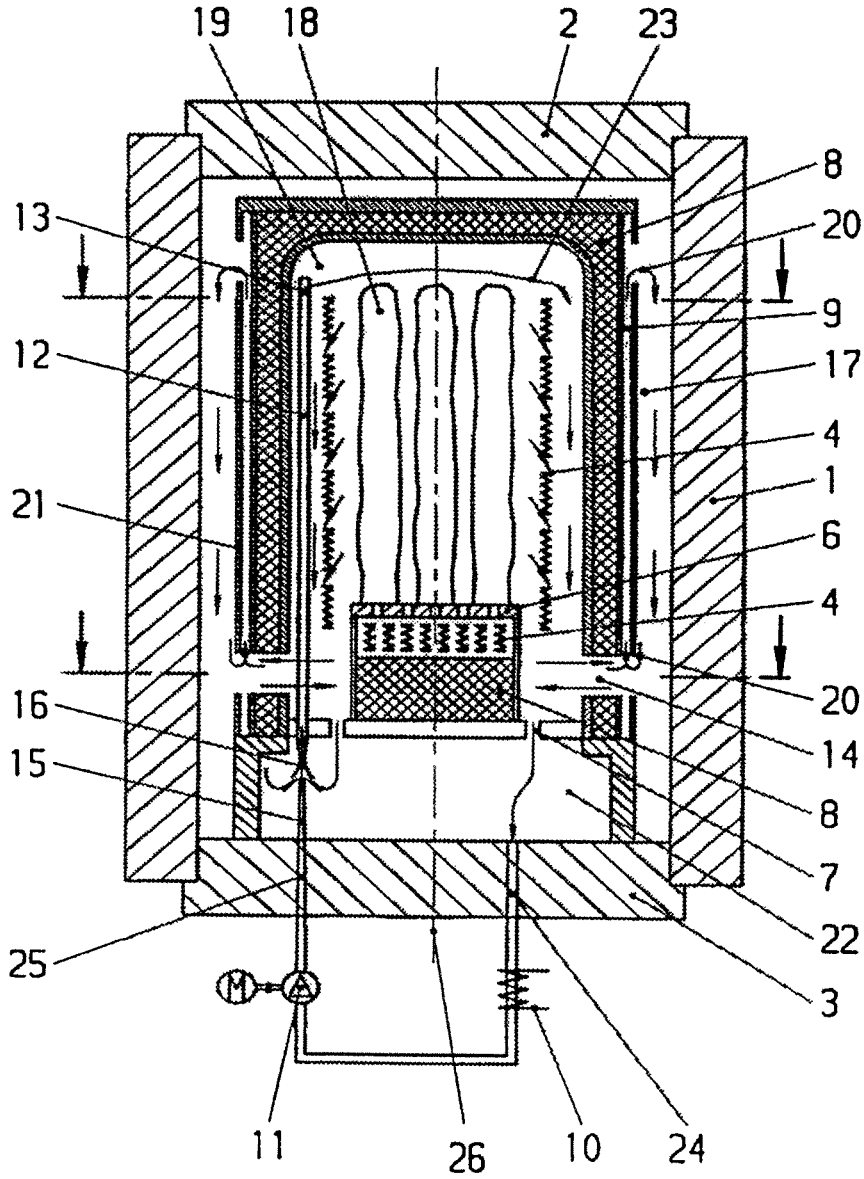
FIG. 1 is a schematic drawing of a vertical sectional view at a central axis of a pressure container with external fluid cooling, according to an exemplary embodiment.
Figure 2:
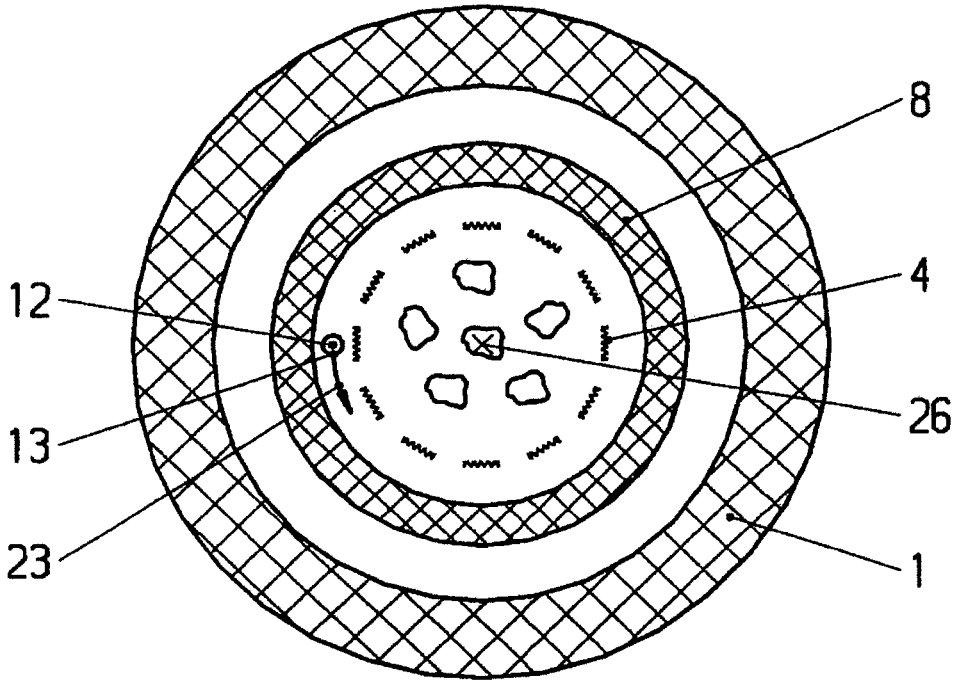
FIG. 2 is a horizontal sectional view in a fluid flow plane in the upper region of the load space of the pressure container of FIG. 1.
Figure 3:
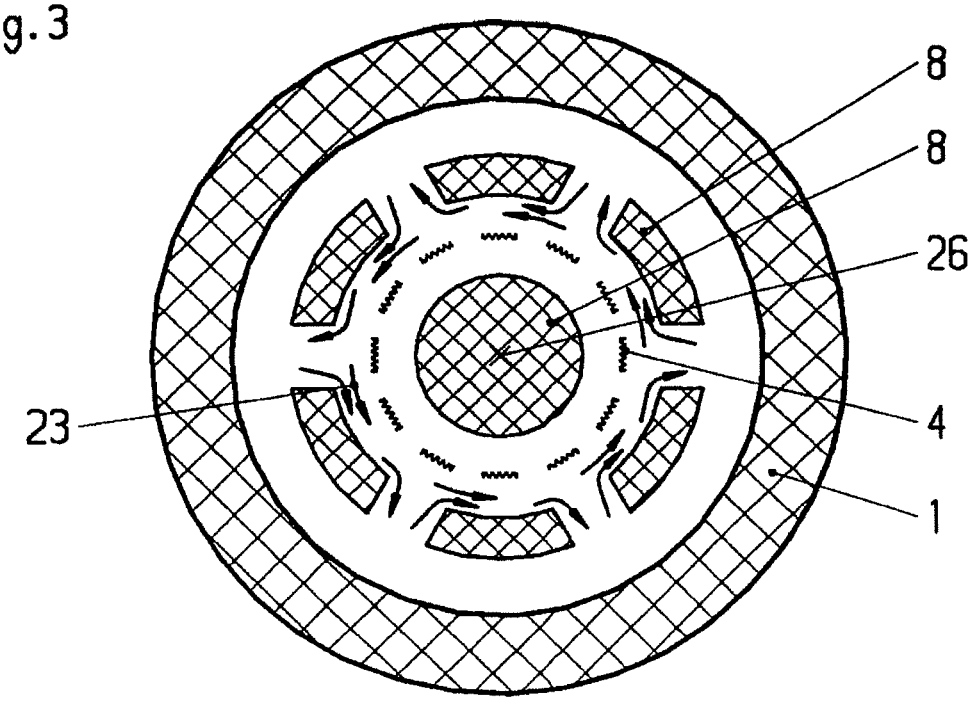
FIG. 3 is a horizontal sectional view of a mixing plane between the regions outside and inside the insulation of the pressure container, according to an exemplary embodiment.

According to various exemplary embodiments, a pressure container 1 includes a load space 19 that is usually located inside or internal to the pressure container 1 and insulation 8 that is disposed in-between. Heating elements 4 are disposed inside the insulation 8 and a load 18 is generally set or mounted on a load bearing plate 6 or can be placed on the load bearing plate 6 by a load carrier (not illustrated). The pressure container 1 includes sealing covers 2 and 3 for loading and unloading the pressure container 1. The sealing covers 2 and 3 are described below as part of the pressure container 1 for simplification. The interior of the insulation 8 includes at least one nozzle 13 in the load space 19 for directing fluid to flow into the load space. The fluid flow is preferably at a high enough speed to form a rotational flow 23. The fluid exhibits a lower temperature than the fluid in the load space 19 and/or near the load 18 itself and is pressed against the inside wall of the insulation 8 by the rotational flow 23. While passing through the rotational flow 23 near the insulation 8, the externally rotating fluid mixes with the warmer fluid from near the load 18. As shown in FIG. 1 in a perpendicular sectional view in relation to the central axis 26 of the pressure container 1, the fluid exhibiting the highest temperature is located near the central axis 26. During a running rotational flow 23, the temperature rises continuously in the direction of the insulation 8. According to one exemplary embodiment, the fluid is directed out of the nozzle 13 horizontally to the central axis 26 of the pressure container 1. A tangential flow of the fluid in relation to the central axis 26 of the pressure container 1 may be optimal. It may also be advantageous for the fluid to flow at a high speed from the nozzle 13 and/or an arrangement of a plurality of nozzles 13. According to FIG. 5, the fluid having a lower temperature is taken either from the bottom space 22 by a circulating device 5 and fed directly into the line 12 or it can be conveyed (as illustrated in the FIGS. 1 and 4) to a fluid cooler 10 and/or a compressor 11 outside the pressure container 1 through an outlet 24 and then fed into the line 12 through an inlet 25.

According to an exemplary embodiment, the cooled fluid returned into the pressure container 1 by the inlet 25 is fed (while simultaneously mixing in fluid from the bottom space 22) into the line 12 by a suction jet pump that includes a sparger 15 and a Venturi nozzle 16 (FIG. 1). To generate the rotational flow 23, the fluid from the breakthroughs or breaks 7 can enter directly in the bottom space 22 from the load space 19 and/or from the second annular gap 17. This structural design can be defined by a desired cooling rate because the fluid from the load space 19 may be significantly warmer than from the second annular gap 17.

To further optimize the rapid cooling of the entire pressure container, an external circulation loop 20 can be established in two parallel annular gaps 9, 17 by natural convection. A baffle plate 21 outside of the insulation 8 is perforated at a top portion and a bottom portion to form annular gap 9. The circulation loop 20 is arranged outside (e.g., totally outside)

the insulation 8. The fluid of the external circulation loop 20 and the rotating fluid from the load space 19 can be interchanged with one another and can mix below the load space by breakthroughs or breaks 14 in the insulation 8. Hot gas from the rotational flow 23 can flow through the breaks 14 into the external circulation loop 20 where it mixes with the external circulation flow. The gas continues to cool down at the wall of the pressure container 1 due to the circulation and as a cooled gas can flow back through the breaks 14 below the load space 19.

Because of the mixing of the externally cooled fluid that is fed through the inlet 25 and/or the fluid that is cooled in the external annular gap 17 by the wall of the pressure container 1, an intensive and rapid cooling of the load space 19 can be achieved during a rapid cooling operation as illustrated in FIG. 1, 4*a*, 4*b*, or 5. It is noted that one of ordinary skilled in the art will recognize a plurality of possible variations within the scope of the disclosure.

Figure 4A:
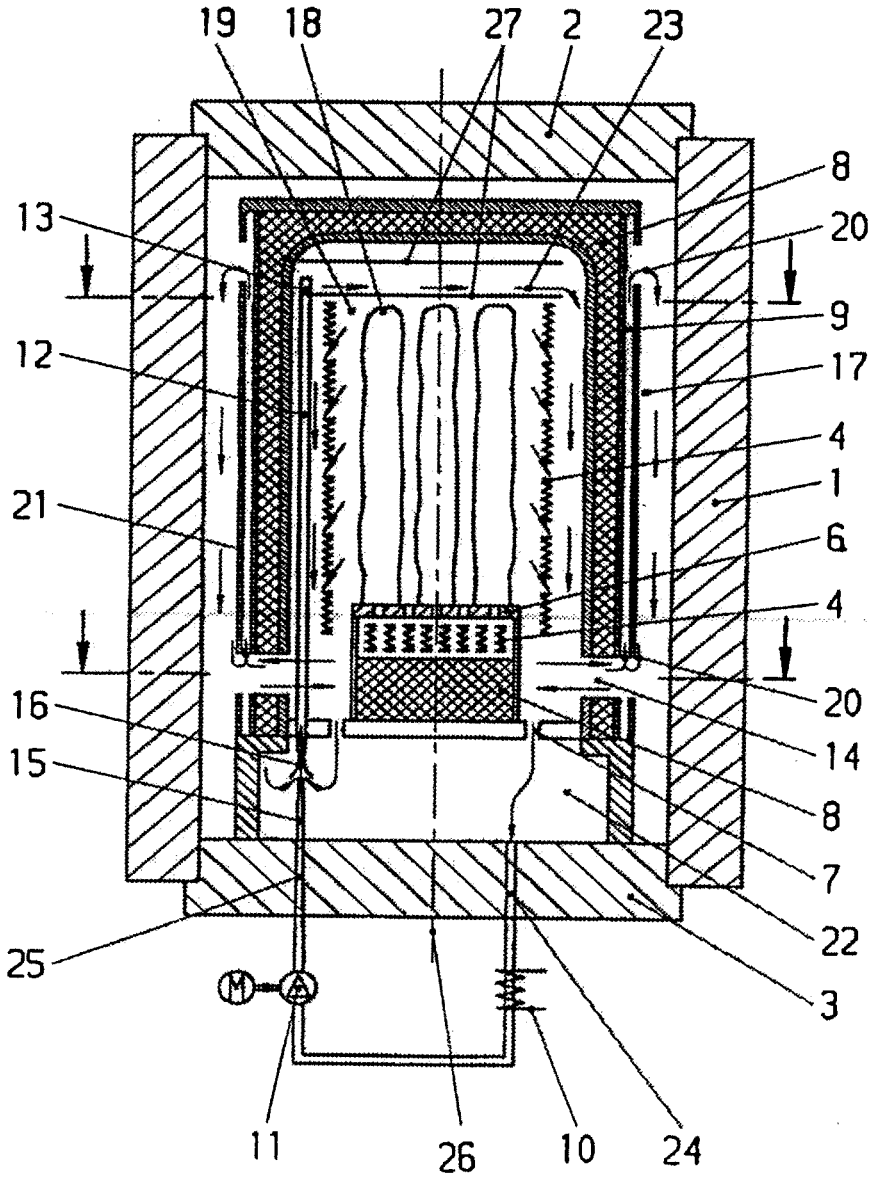
FIGS. 4*a* and 4*b* show two exemplary embodiments of guiding devices for the fluid in the upper region of the load space.
Figure 4B:
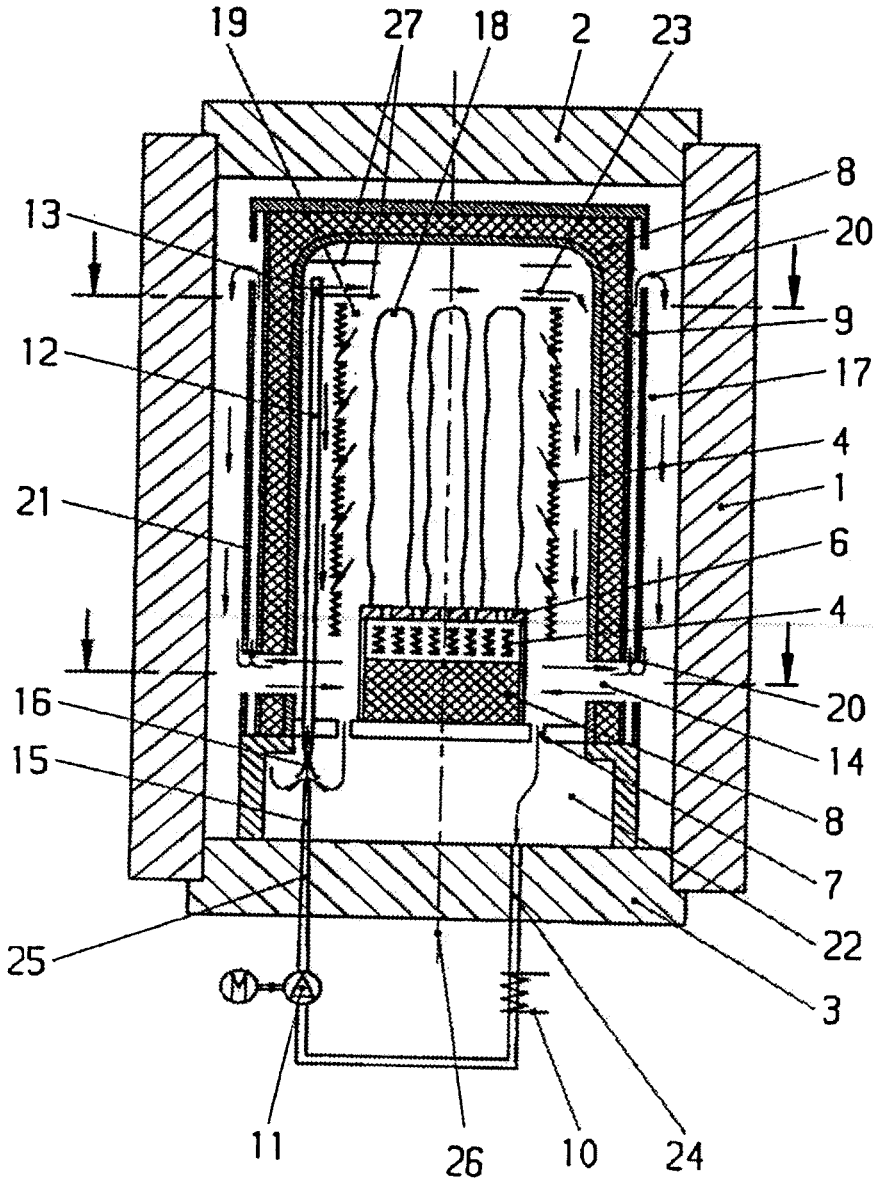

Referring to FIGS. 4*a* and 4*b*, according to another exemplary embodiment the fluid is directed into the load space 19 by the nozzle 13 in or above a guiding device 27. The guiding device 27 may be a single or double horizontally arranged disk (FIG. 4*a*) or a ring (FIG. 4*b*) that increases the likelihood that the cooler fluid from the nozzle 13 flows to the outer edge of the load space 19 formed by the insulation 8 before entering into the rotational flow 23. Therefore, an uncontrolled flow of the cooler fluid into the center of the load space 19 can be avoided.

The guiding device 27 may also or alternatively be a horizontally arranged double steel sheet or double ring, as shown in FIGS. 4*a*, 4*b*. Therefore, the flow of the cooler fluid from the nozzle 13 between the two steel sheets allows a more optimal and narrowly defined gas guide independent of the shape and height of the upper region of the insulation 8 (roof).

According to other exemplary embodiments, the guiding device 27 could be another nozzle 13 so that the fluid entering into the guiding device 27 through the nozzle 13 generates a primary rotational flow inside the double steel sheet. Thereafter the fluid can enter into the load space 19 near the wall of the insulation 8 and at least one of the entry ports can have a similar orientation to the nozzle 13.

According to other exemplary embodiments, the fluid may be delivered from the nozzle 13 into a suction jet nozzle (not illustrated) to force the cool fluid from the nozzle 13 to almost immediately mix with the hot fluid from near the upper insulation 8.

Figure 5:
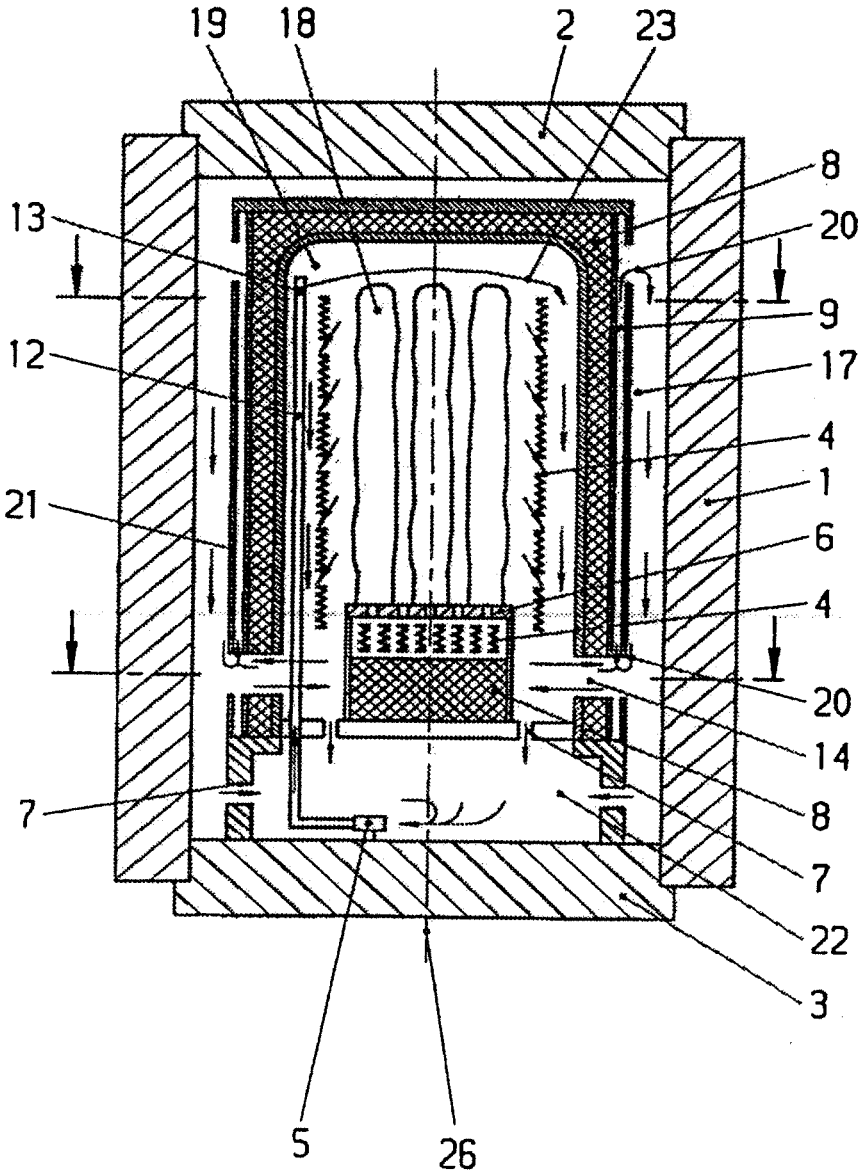
FIG. 5 is a vertical sectional view of a central axis of a pressure container including internal rapid cooling with a circulating device, according to an exemplary embodiment.

According to still other exemplary embodiments, additional breaks 7 can be provided between the external annular gap 17 and the bottom space 22 and the fluid that is cooled down at the wall of the pressure container can flow back directly into the bottom space 22 (FIG. 5).

Germany Priority Application DE 10 2007 023 699.0, filed May 22, 2007 including the specification, drawings, claims and abstract, is incorporated herein by reference in its entirety.

Given the disclosure of the application, one versed in the art would appreciate that there may be other embodiments and modifications within the scope and spirit of the application. Accordingly, all modifications attainable by one versed in the art from the present disclosure within the scope and spirit of the present application are to be included as further embodiments of the present application. The scope of the present application is to be defined as set forth in the following claims.

What is claimed is:

1. A method for rapid cooling a hot isostatic press comprising a pressure container having an internal load space and comprising insulation disposed at least partially around the load space, heating elements disposed inside the insulation, and a load disposed on a load bearing plate, the method comprising:

directing fluid into the load space of a pressure container using at least one nozzle located in an upper region of the load space and near an inner sidewall of the insulation, the fluid from the at least one nozzle forms a rotational flow around a central axis of the pressure container, wherein the rotational flow is in contact with the load and forms along a perimeter of the insulation; and mixing the fluid from the at least one nozzle as it passes through the rotational flow around the central axis near the insulation with fluid near the load, wherein the fluid from the at least one nozzle has a lower temperature than the fluid in the load space and/or the load, wherein the fluid from the at least one nozzle is directed into the load space tangentially to the central axis of the pressure container.

2. The method as claimed in claim 1, wherein the fluid from the at least one nozzle is tangentially directed downwards or upwards into the load space at an angle that is inclined in relation to a horizontal line.

3. The method as claimed in claim 1, wherein the fluid from the at least one nozzle is directed into the load space at a high speed.

4. The method as claimed in claim 1, wherein the fluid from the at least one nozzle is fed directly from a bottom space into a line, the fluid from the at least one nozzle having a lower temperature than the line.

5. The method as claimed in claim 1, wherein fluid is delivered to a fluid cooler outside the pressure container by an outlet and subsequently is fed into a line by way of an inlet.

6. The method as claimed in claim 1, wherein fluid is cooled outside the pressure container and is fed directly and/or with an admixture of fluid from a bottom space into a line by a suction jet pump comprising a sparger and a Venturi nozzle.

7. The method as claimed in claim 1, wherein an external circulation loop is formed in parallel annular gaps by natural convection to further optimize the cooling, the circulation loop being arranged outside of the insulation.

8. The method as claimed in claim 7, wherein fluid enters the external circulation loop from breaks in the insulation below the load space and mixes with the fluid of the external circulation loop, the fluid flowing past a wall of the pressure container in the circulation loop and flowing with a lower temperature back to the load space through breaks below the load space.

9. The method as claimed in claim 1, wherein fluid flows into a bottom space of the load space through vertically or horizontally situated breaks of the load space.

10. The method as claimed in claim 1, wherein the fluid from the at least one nozzle is directed into a guiding device prior to entering the load space, the guiding device delivering the fluid from the at least one nozzle into an outer region near a wall of the insulation at least partially around the load space.

11. The method as claimed in claim 1, wherein the fluid from the at least one nozzle is directed into a guiding device prior to entering the load space, a first rotational flow being generated in the guiding device before the guiding device delivers the fluid from the at least one nozzle into an outer region near a wall of the insulation at least partially around the load space.

12. A hot isostatic press, comprising:

a pressure container having an internal load space, the pressure container comprising:

an insulation disposed at least partially around the load space;

heating elements disposed inside the insulation;

a load disposed on a load bearing plate;

at least one nozzle located in an upper region of the internal load space and near an inner sidewall of the insulation, the at least one nozzle configured to direct fluid into the load space to form a rotational flow around a central axis of the pressure container, wherein the rotational flow is in contact with the load and forms along a perimeter of the insulation; and at least one line with a connection to the at least one nozzle in the load space, wherein the at least one line is arranged inside the pressure container and is provided with a fluid having a lower temperature than a fluid in the load space and/or the load, wherein an outflow direction of the at least one nozzle is horizontal and/or tangential to the central axis of the pressure container.

13. The hot isostatic press as claimed in claim 12, wherein the outflow direction of the at least one nozzle is tangential to the central axis and is inclined downwards or upwards from a horizontal line.

14. The hot isostatic press as claimed in claim 12, wherein the at least one line runs in and/or through a bottom space.

15. The hot isostatic press as claimed in claim 14, wherein the bottom space houses a circulating device for feeding the at least one line with fluid from the bottom space.

16. The hot isostatic press as claimed in claim 15, wherein the bottom space has an inlet for delivering cooled fluid.

17. The hot isostatic press as claimed in claim 16, wherein the bottom space has an outlet connected to a fluid cooler and/or a compressor outside the pressure container, the compressor being also connected to the inlet.

18. The hot isostatic press as claimed in claim 16, wherein the bottom space houses a suction jet pump comprising a sparger and a Venturi nozzle, the sparger being connected to the inlet.

19. The hot isostatic press as claimed in claim 12, wherein the insulation comprises a baffle plate on the outside of the insulation, the baffle plate being perforated at a top portion and a bottom portion to form an annular gap.

20. The hot isostatic press as claimed in claim 14, wherein the insulation has breaks between the load space and the bottom space.

21. The hot isostatic press as claimed in claim 19, wherein breaks are disposed between the load space and/or the annular gap and the bottom space.

22. The hot isostatic press, as claimed in claim 12, wherein a guiding device comprising at least one horizontal steel sheet is disposed between the load space and the nozzle.

* * * * *